US006035671A

United States Patent [19]

Woods

[11] Patent Number: 6,035,671

[45] Date of Patent: Mar. 14, 2000

[54] SPLASH PROOF DRAIN SYSTEM PROVIDING MECHANICAL ISOLATION BETWEEN A MOVABLE DRAIN LINE AND A FIXED CONDUIT AND SUITABLE FOR USE IN A SEMICONDUCTOR FABRICATION CLEAN ROOM

[75] Inventor: Robert L. Woods, Johnson City, Tex.

[73] Assignee: Advanced Micro Devices, Inc., Sunnyvale, Calif.

[21] Appl. No.: 09/167,121

[22] Filed: Oct. 6, 1998

[51] Int. Cl.[7] ..... D06F 39/08; F16L 27/00

[52] U.S. Cl. ..... 68/208; 4/679; 285/9.2; 285/224

[58] Field of Search ..... 68/208, 24; 134/155, 134/186; 137/247.35, 362; 4/679; 285/9.2, 224, 225

[56] References Cited

U.S. PATENT DOCUMENTS

| | | | |
|---|---|---|---|
| 2,639,601 | 5/1953 | Miller | 68/208 X |
| 3,231,909 | 2/1966 | Candor | 68/208 X |
| 3,970,333 | 7/1976 | Pelzer | 285/224 X |

FOREIGN PATENT DOCUMENTS

| | | | |
|---|---|---|---|
| 104398 | 4/1990 | Japan | 68/208 |

OTHER PUBLICATIONS

Washtex MCR Microcontamination (Clean Room) Laundry System product brochure from Washtex Machinery Company, a Division of White Consolidated Industries, Wichita Falls, Texas, published Jan. 1993, 12 pages.

*Primary Examiner*—Philip R. Coe

*Attorney, Agent, or Firm*—Kevin L. Daffer; Conley, Rose & Tayon

[57] ABSTRACT

A drain system is presented for conveying a liquid (e.g., water) exiting an end of a drain line. The drain line may be, for example, mechanically coupled to a drum of a washing machine, and may undergo limited movement during operation of the washing machine. The drain system includes a conduit and a splash plate, and provides mechanical isolation between the moveable drain line and the fixed conduit. The splash plate allows limited relative movement between the drain line and the conduit while providing a substantially splash proof connection between the drain line and the conduit. The drain system is suitable for use within a semiconductor fabrication clean room. The conduit has an axis substantially aligned with an axis of the drain line, and has an end with an opening larger than an outer dimension of the drain line. A lip surrounds the opening in the end of the conduit. The splash plate has a substantially planar bottom surface and a hole extending through splash plate and dimensioned to receive the drain line. The end of the drain line extends through the hole in the splash plate and into the conduit opening, and the bottom surface of the splash plate makes continuous contact with the conduit lip.

17 Claims, 4 Drawing Sheets

SPLASH PROOF DRAIN SYSTEM PROVIDING MECHANICAL ISOLATION BETWEEN A MOVABLE DRAIN LINE AND A FIXED CONDUIT AND SUITABLE FOR USE IN A SEMICONDUCTOR FABRICATION CLEAN ROOM

BACKGROUND OF THE INVENTION

1. Field of the Invention

This invention relates to equipments having liquid drain lines which may undergo limited movement during use, and which must be connected to fixed drain conduits (e.g., commercial/industrial washing machines).

2. Description of Related Art

It is well known that small particles (i.e., particulates) can cause defects in integrated circuits formed upon semiconductor wafers. Such defects may prevent the integrated circuits from performing their intended functions. For example, a process called photolithography is used to pattern layers of desired materials deposited upon the semiconductor wafers. During photolithography, light passing through a pattern on a mask transfers the pattern to a layer of light-sensitive photoresist deposited over a layer of desired material. Particulates on the surface of the mask or on the surface of the photoresist layer which block or diffuse the light cause imperfect pattern registrations (i.e., imperfect feature formations). The resulting imperfect features formed within an integrated circuit may render the integrated circuit inoperable.

In order to help keep wafer processing areas as particle free, (i.e., "clean") as possible, such areas are designated as "clean rooms". Particulates may be present within the air in clean rooms, introduced by processing personnel, suspended in liquids and gasses used during wafer processing, and generated by processing equipment located within the clean rooms. As a result, the air within clean rooms is typically continuously filtered. Liquids and gasses entering clean rooms and used during processing are also filtered, and clean rooms typically exclude portions of processing equipment which generate particulates.

Air "cleanliness" levels of clean rooms are determined by the densities of different sizes of particulates present in the air and are specified using class numbers. The allowable densities of particulates within clean rooms is dependent upon the clean room class numbers and the largest dimensions of the particulates. For example, a class 1 clean room can have only 1 particle with a largest dimension of 0.5 micron in each cubic foot of air, but may have up to 34 particles with largest dimensions of 0.1 micron per cubic foot of air. The required class number for a particular clean room is largely determined by the feature sizes of the integrated circuit devices being produced within the clean room. Portions of many integrated circuits produced today are formed within class 1 clean rooms.

Humans continuously generate large numbers of particulates including dead skin cells and hairs. When working in clean rooms, personnel typically wear low-particle-generating coverings which almost completely envelope their bodies. The clean room garments essentially form filters around the wearers, reducing the number of particulates generated by the wearers which escape into the air. Exemplary garments include overalls and hoods, face masks, safety glasses or goggles, leggings, shoe covers, and gloves. Undergarments such as caps or nets may also be used to keep hair in place under hoods.

Clean room garments must be laundered on a regular basis if they are to remain functional and sanitary. The laundering process must, however, be carried out such that the clean room garments do not become sources of large number of particulates. For example, particles present in the water used to wash the clean room garments, or particles of a laundering agent (e.g., a detergent) added to the water, may become trapped in fibers of the clean room garments during laundering. Such particles may be released into the air during wear of the garments. Improper laundering may also damage the fibers of the clean room garments, causing them to break apart. In this case, small pieces of the fibers may be released into the air during wear. No matter how carefully the laundering process is carried out, transport of laundered clean room garments through the relatively "dirty" environment between an off-site laundering facility and the clean room presents a particle contamination problem. In fact, the plastic bags routinely used to protect laundered garments are themselves particle generators, rendering them ineffective in protecting clean room garments from the introduction of particles during transit. It is thus highly desirable to locate appliances used to launder clean room garments within the clean room itself.

Several different types of textile laundering appliances (e.g., commercial/industrial washing machines) use water to launder textiles (e.g., garments). One example of such a laundering appliance is a washer/extractor 10 depicted in FIG. 1. FIG. 2 is a side cross-sectional view of washer/extractor 10. Washer extractor 10 includes a cylindrical drum 12 mounted within a housing 14. During a typical use, soiled garments are placed within drum 12, drum 12 is filled to a certain level with water, detergent is added to the water in drum 12, and drum 12 is rotated about a horizontal axis 16 in order to flush foreign substances from the garments.

Drum 12 is essentially a hollow cylinder with circular plates covering both open ends of the hollow cylinder. In the embodiment of FIG. 2, drum 12 is divided into two compartments or "pockets" 18*a* and 18*b* of substantially equal volume by a planar partition 20. Partition 20 is perpendicular to and extends between both circular plates of drum 12. Three access doors 22 in the curved outer surface of drum 12 allow access to pocket 18*a*. Similarly, three access doors 24 in the curved outer surface of drum 12 allow access to pocket 18*b*. During use, pockets 18*a* and 18*b* are loaded with substantially equal weights of garments to minimize reciprocal motion imparted upon housing 14 by drum 12 due to the rotating eccentric masses of wet garments.

Washer/extractor 10 is designed for isolation of laundered and soiled garments, and subsequently has a load side 26 and an unload side 28. Soiled garments may be stored in an area adjacent to load side 26 and loaded into drum 12 from load side 26. Laundered garments are removed from drum 12 from unload side 28, and may be stored in an area adjacent to unload side 28. As a result, a significant amount of physical separation is achieved between laundered and soiled garments.

Washer/extractor 10 also includes an outer shell 30 surrounding drum 12 having two arcuate shell doors 32*a* and 32*b*. Shell door 32*a* is located on load side 26 of outer shell 30, and is shown in a closed position. When drum 12 is suitably rotated and shell door 32*a* is in an open position, shell door 32*a* allows access to access doors 22 for loading soiled garments into pocket 18*a*, and allows access to access doors 24 for loading soiled garments into pocket 18*b*. Shell door 32*b* is located on unload side 28 of outer shell 30, and is shown in an open position. As shown, shell door 32*b* allows access to access doors 22 for removing laundered garments from pocket 18*a*. When drum 12 is suitably rotated, open shell door 32*b* allows access to access doors 24 for removing laundered garments from pocket 18*b*.

Washer/extractor 10 includes a drain line 34 extending outwardly and downwardly from outer shell 30 for removing water from drum 12 by draining. A drain valve (not shown) between drum 12 and drain line 34 controls a flow of water from drum 12 into a top end of drain line 34. A floor 38 supports washer/extractor 10, and a bottom end of drain line 34 extends into an open trench 36 formed within floor 38. Trench 36 is connected to a sanitary sewer line 39 located directly below drain line 34.

In order to remove a substantial amount of water from the textiles within drum 12, the textiles may be subjected to "extraction" operations. During an extraction operation, drum 12 is rotated about horizontal axis 16 at a relatively high rate of speed. Centrifugal force acting radially upon the water retained by the textiles causes the water to leave the textiles and move from drum 12 to outer shell 30 through openings (e.g., perforations) in drum 12. During the relatively high rotational speeds employed during extraction operations, drum 12 may impart a substantial amount of reciprocal motion upon housing 14 and connected floor 38 due to the rotating eccentric masses of wet garments within drum 12. In order to mechanically isolate housing 14 and connected floor 38 from such reciprocal motion, drum 12 and surrounding outer shell 30 may be raised above a normal position and held there by a suspension system during extraction operations. FIG. 3 is a side cross-sectional view of washer/extractor 10 with drum 12 and surrounding outer shell 30 raised a height h above a normal position during such an extraction operation. Height h may be, for example, about 1.5 inches. The drain valve is typically open during extraction operations, allowing water to flow from drum 12 into drain line 34.

Drain line 34 is connected to outer shell 30, and thus moves with outer shell 30. In addition to the vertical movement of drain line 34 due to activation of the mechanical isolation system, drain line 34 may also undergo a significant amount of lateral movement during extraction operations due to the reciprocal motion of drum 12. As a result, a lateral clearance "c" about drain line 34 is typically incorporated into the dimension of the upper opening of trench 36 in order to accommodate the lateral movement of drain line 34 during extraction operations. Clearance c may be, for example, about 3.5 inches±0.5 inch.

A problem arises when using washer/extractor 10 within a clean room environment. Due to clearance c about drain line 34 to accommodate the lateral movement of drain line 34 during extraction operations, a portion 40 of water 42 entering trench 36 from drain line 34 may splash out of the upper opening of trench 36 and onto floor 38 surrounding trench 36. Portion 40 of water 42 may contain dissolved chemicals (e.g., detergent) and/or particulate matter flushed from the textiles within drum 12. When the water evaporates, the previously dissolved particulates may become airborne. As such, portion 40 of water 42 represents a source of particulate contamination within the clean room.

It would thus be desirable to have a drain system which does not allow portion 40 of water 42 to splash out of the upper opening of trench 36 and onto floor 38 surrounding trench 36. When used with a laundering appliance installed within a clean room, such a drain system would reduce particulate contamination within the clean room.

SUMMARY OF THE INVENTION

The problems outlined above are in large part solved by a drain system used to convey a liquid (e.g., water) exiting an end of a drain line. The drain line may be, for example, mechanically coupled to a drum of a washing machine, and may undergo limited movement during operation of the washing machine. The drain system includes a conduit and a splash plate, and provides mechanical isolation between the moveable drain line and the fixed conduit. The splash plate allows limited relative movement between the drain line and the conduit while providing a substantially splash proof connection between the drain line and the conduit. The drain system is suitable for use within a semiconductor fabrication clean room.

The conduit has an axis substantially aligned with an axis of the drain line, and has an end with an opening larger than an outer dimension of the drain line. A lip surrounds the opening in the end of the conduit. The splash plate has a substantially planar bottom surface and a hole extending through the splash plate, wherein the hole is dimensioned to receive the drain line. The end of the drain line extends through the hole in the splash plate and into the conduit opening, and the bottom surface of the splash plate makes continuous contact with the conduit lip despite any lateral movement of the splash plate relative to the conduit lip.

The hole in the splash plate forms an inner dimension (e.g., diameter) of the splash plate. A space exists between the outer dimension of the drain line and the inner dimension of the splash plate. The space is preferably dimensioned to allow limited relative movement between the drain line and the conduit along the aligned axes of the drain line and the conduit while providing a substantially splash proof joint between the drain line and the splash plate. The continuous contact between the bottom surface of the splash plate and the conduit lip allows limited relative movement between the drain line and the conduit in a direction perpendicular to the aligned, elongated axes of the drain line and the conduit while providing a substantially splash proof joint between the splash plate and the conduit.

The aligned axes of the drain line and the conduit may be substantially vertical, and the substantially planar bottom surface of the splash plate may form a substantially horizontal plane. The weight "W" of the splash plate urges the splash plate toward the conduit lip with a force F=W such that the bottom surface of the splash plate makes continuous contact with the conduit lip despite any relative movement between the drain line and the conduit.

The maximum allowable amount of movement between the drain line and the conduit perpendicular to the axes thereof is a distance "$d_1$" between an outer dimension of the drain line and an inner dimension of the conduit opening. In order for the splash plate to accommodate the maximum allowable amount of movement between the drain line and the conduit, an outer edge of the splash plate must extend beyond an outer edge of the conduit lip a distance "$d_2$" where distance $d_2$ is greater than or equal to distance $d_1$.

The drain line and the conduit may have substantially circular cross sections, and the conduit lip may be substantially circular. The splash plate may be a substantially circular disk having a substantially planar top surface opposed to the bottom surface. The hole in the splash plate may be substantially circular, extending between the opposed top and bottom surfaces. The end of the conduit may be flared such that the conduit opening forms a mouth having a diameter greater than an outer diameter of the drain line.

Any portion of water exiting the drain line and entering the conduit opening which splashes up between the drain line and the inner dimension of the conduit impacts the splash plate and is contained within the drain system.

Employed within a clean room, the drain system prevents a portion of the water, possibly containing dissolved chemicals (e.g., detergent) and/or particulate matter flushed from the textiles within the drum, from splashing out of the drain system and becoming a source of particulate contamination within the clean room. Although not airtight, the drain system may also help isolate the area within the conduit from the area surrounding the drain system.

In a clean room application, the conduit and splash plate are preferably fabricated from stainless steel. In other applications, the conduit and splash plate may be made from a non-corrosive metal (e.g., aluminum), made from a metal and subsequently coated with a non-corrosive coating (e.g., chromium, zinc, plastic, enamel, etc.), or from a plastic (e.g., polyvinyl chloride).

BRIEF DESCRIPTION OF THE DRAWINGS

Other objects and advantages of the invention will become apparent upon reading the following detailed description and upon reference to the accompanying drawings in which.

Figure 1:
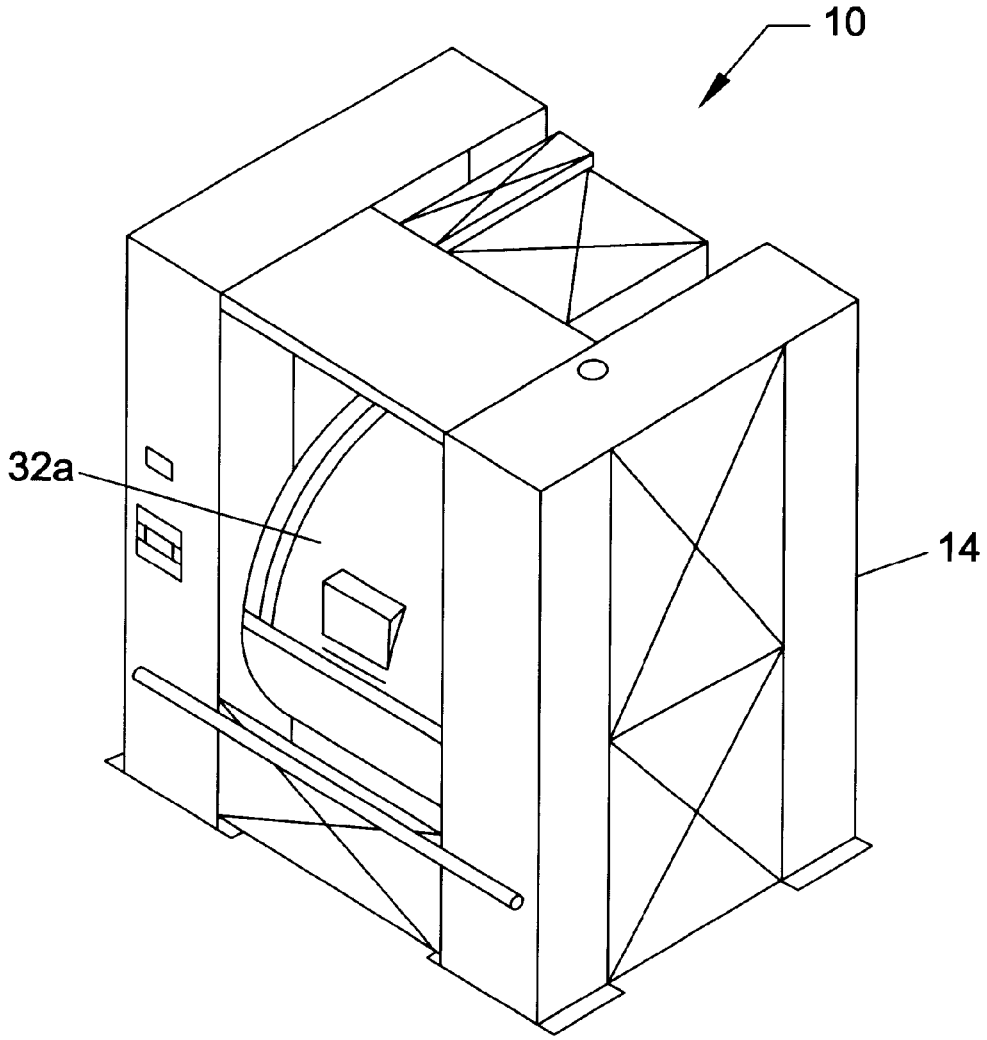
Fig. 1 (Prior Art)
FIG. 1 is an isometric view of an exemplary washer/extractor.
Figure 2:
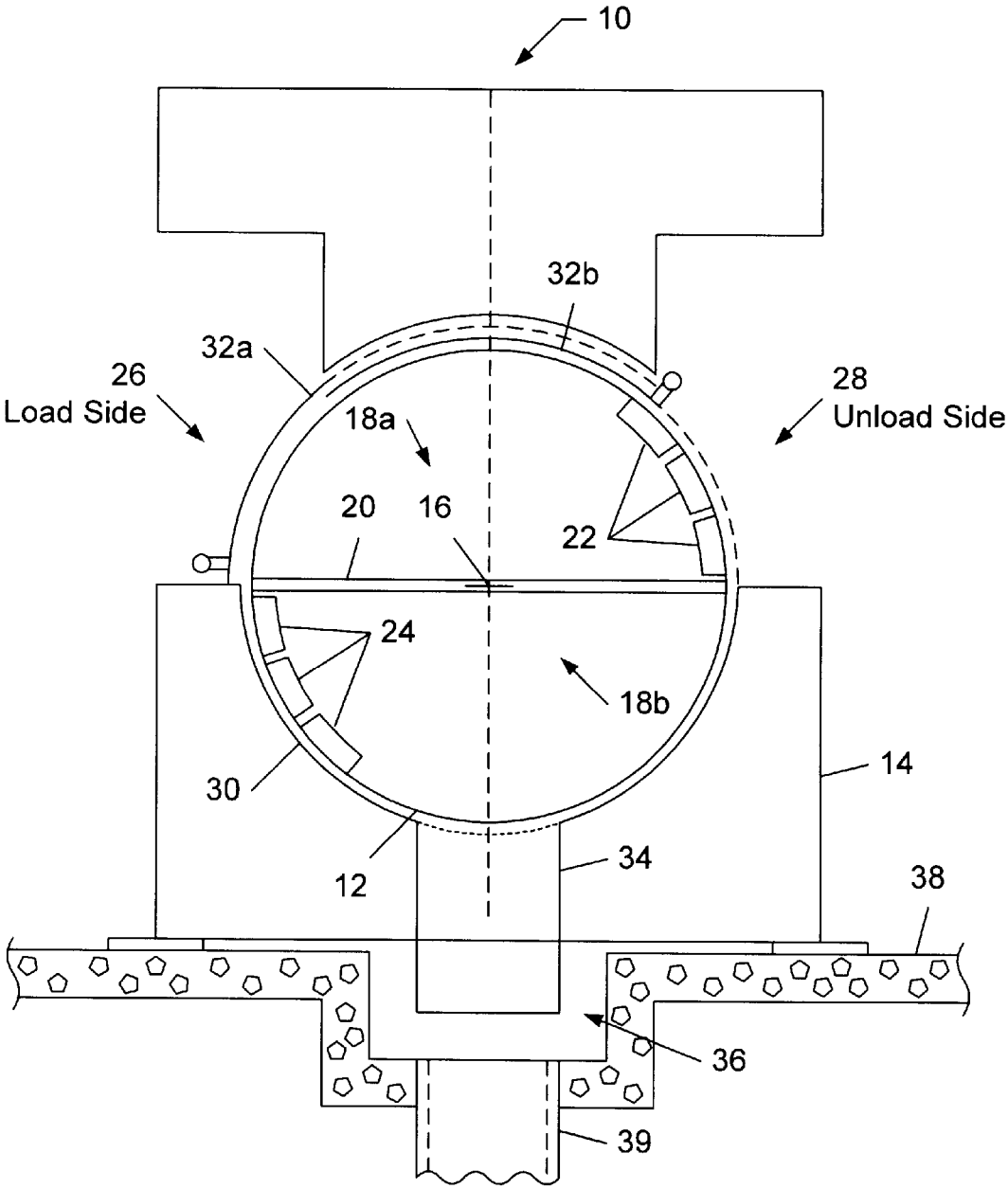
Fig. 2 (Prior Art)
FIG. 2 is a side cross-sectional view of the washer/extractor of FIG. 1 illustrating a drain line of the washer/extractor and a typical trench drain system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 4:
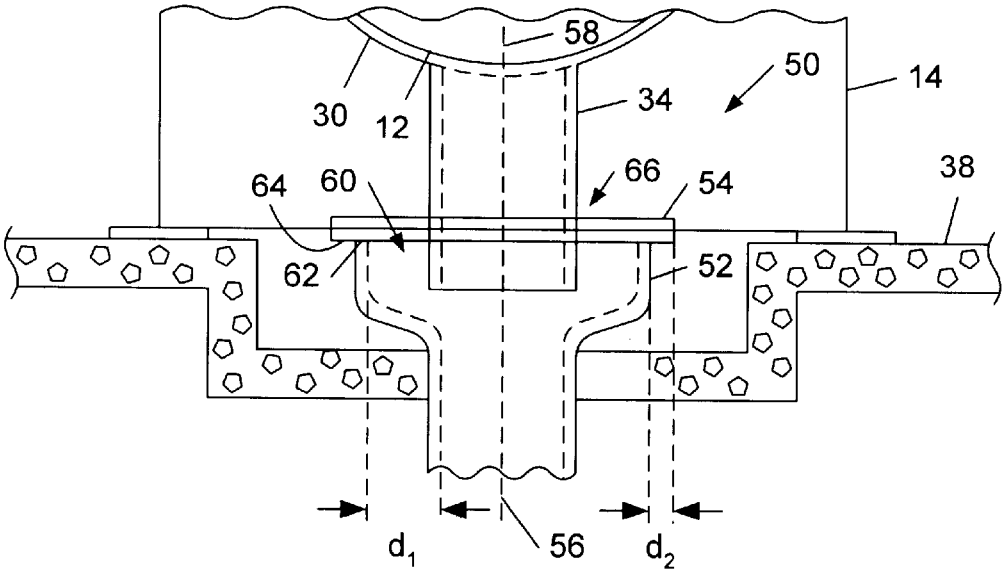
FIG. 4 is a side cross-sectional view of one embodiment of a drain system according to the present invention, wherein the drain system includes a conduit and a splash plate.

FIG. 4 is a side cross-sectional view of one embodiment of a drain system 50 according to the present invention. Drain system 50 is used to convey a liquid (e.g., water) exiting an end of a drain line (e.g., drain line 34), and may be located within a semiconductor fabrication clean room. Drain system 50 includes a conduit 52 and a splash plate 54. Conduit 52 has an axis 56 substantially aligned with an axis 58 of drain line 34. Conduit 52 has an end with an opening 60 larger than an outer dimension of drain line 34. A lip 62 surrounds opening 60 in the end of conduit 52. Splash plate 54 has a substantially planar bottom surface 64 and a hole 66 extending through splash plate 54, wherein hole 66 is dimensioned to receive drain line 34. The end of drain line 34 extends through hole 66 in splash plate 54 and into opening 60, and bottom surface 64 of splash plate 54 makes continuous contact with lip 62.

Hole 66 in splash plate 54 forms an inner dimension (e.g., diameter) of splash plate 54. A space exists between the outer dimension of drain line 34 and the inner dimension of splash plate 54. The space is preferably dimensioned to allow limited relative movement between drain line 34 and conduit 52 along aligned axes 56 and 58 while providing a substantially splash proof joint between drain line 34 and splash plate 54. The continuous contact between bottom surface 64 of splash plate 54 and lip 62 of conduit 52 allows limited relative movement between drain line 34 and conduit 52 in a direction perpendicular to aligned axes 56 and 58 while providing a substantially splash proof joint between splash plate 54 and conduit 52. As a result, splash plate 54 allows limited relative movement between drain line 34 and conduit 52 while providing a substantially splash proof connection between drain line 34 and conduit 52.

Figure 5:
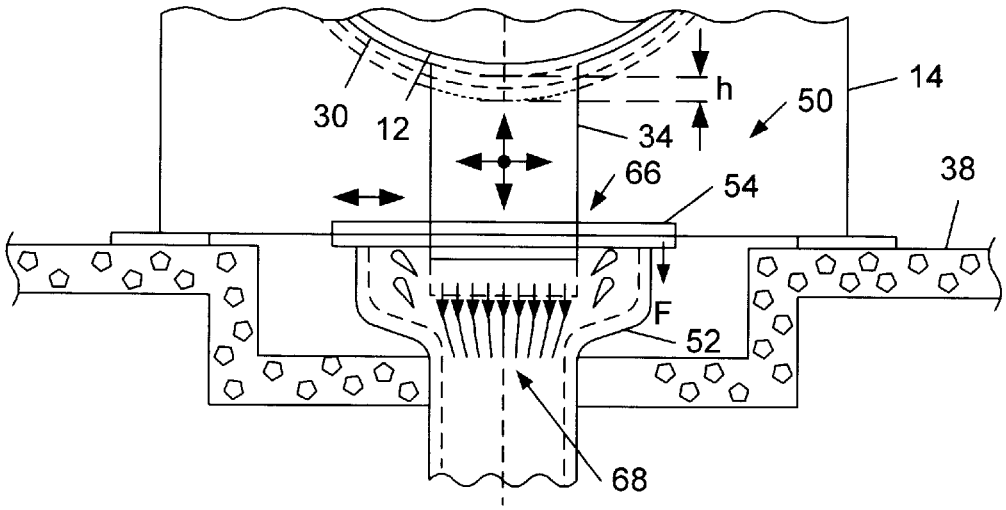
FIG. 5 is a side cross-sectional view of the embodiment of the drain system of FIG. 4 during an extraction operation, wherein the drain system allows limited movement between the drain line and the conduit, and wherein water exits the drain line and enters an opening in an end of the conduit, and wherein any portion of the water splashing back toward the drain line impacts the splash plate and is contained within the drain system.

FIG. 5 is a side cross-sectional view of the embodiment of drain system 50 of FIG. 4 during an extraction operation described above. During the extraction operation, drum 12 and surrounding outer shell 30 are raised a height "h" above a normal position and held there by a suspension system during extraction operations. Height h may be, for example, about 1.5 inches. The space between the outer dimension of drain line 34 and the inner dimension of splash plate 54 formed by hole 66 allows limited relative movement between drain line 34 and conduit 52 along aligned axes 56 and 58 while providing a substantially splash proof joint between drain line 34 and splash plate 54. In order for the end of drain line 34 to continue to extend through hole 66 in splash plate 54 and into opening 60 after the end of drain line 34 is raised height h above the normal position, the length of the portion of drain line 34 extending below bottom surface 64 of splash plate 54 in the normal position must exceed dimension h.

Axes 56 and 58 may be substantially vertical, and substantially planar bottom surface 64 of splash plate 54 may form a substantially horizontal plane as shown in FIGS. 4 and 5. The weight "W" of splash plate 54 urges splash plate 54 toward lip 62 of conduit 52 with a force F=W such that bottom surface 62 of splash plate 54 makes continuous contact with lip 62 despite any relative movement between drain line 34 and conduit 52.

During the extraction operation, drum 12 is rotated about horizontal axis 16 at a relatively high rate of speed as described above in order to remove a substantial amount of water from the textiles (e.g., garments) within drum 12. Drum 12 may experience reciprocal motion due to the rotating eccentric masses of the wet textiles within drum 12. Drain line 34 is mechanically coupled to drum 12, and the reciprocal motion of drum 12 may be transmitted to drain line 34. As a result, drain line 34 may move parallel to axes 56 and 58 (e.g., vertically) and/or perpendicular to aligned axes 56 and 58 (e.g., horizontally or laterally). Again, the space between the outer dimension of drain line 34 and the inner dimension of splash plate 54 formed by hole 66 allows limited relative movement between drain line 34 and conduit 52 along aligned axes 56 and 58 while providing a substantially splash proof joint between drain line 34 and splash plate 54. The continuous contact between bottom surface 64 of splash plate 54 and lip 62 of conduit 52 allows limited relative movement between drain line 34 and conduit 52 in a direction perpendicular to aligned axes 56 and 58 while providing a substantially splash proof joint between splash plate 54 and conduit 52.

Figure 3:
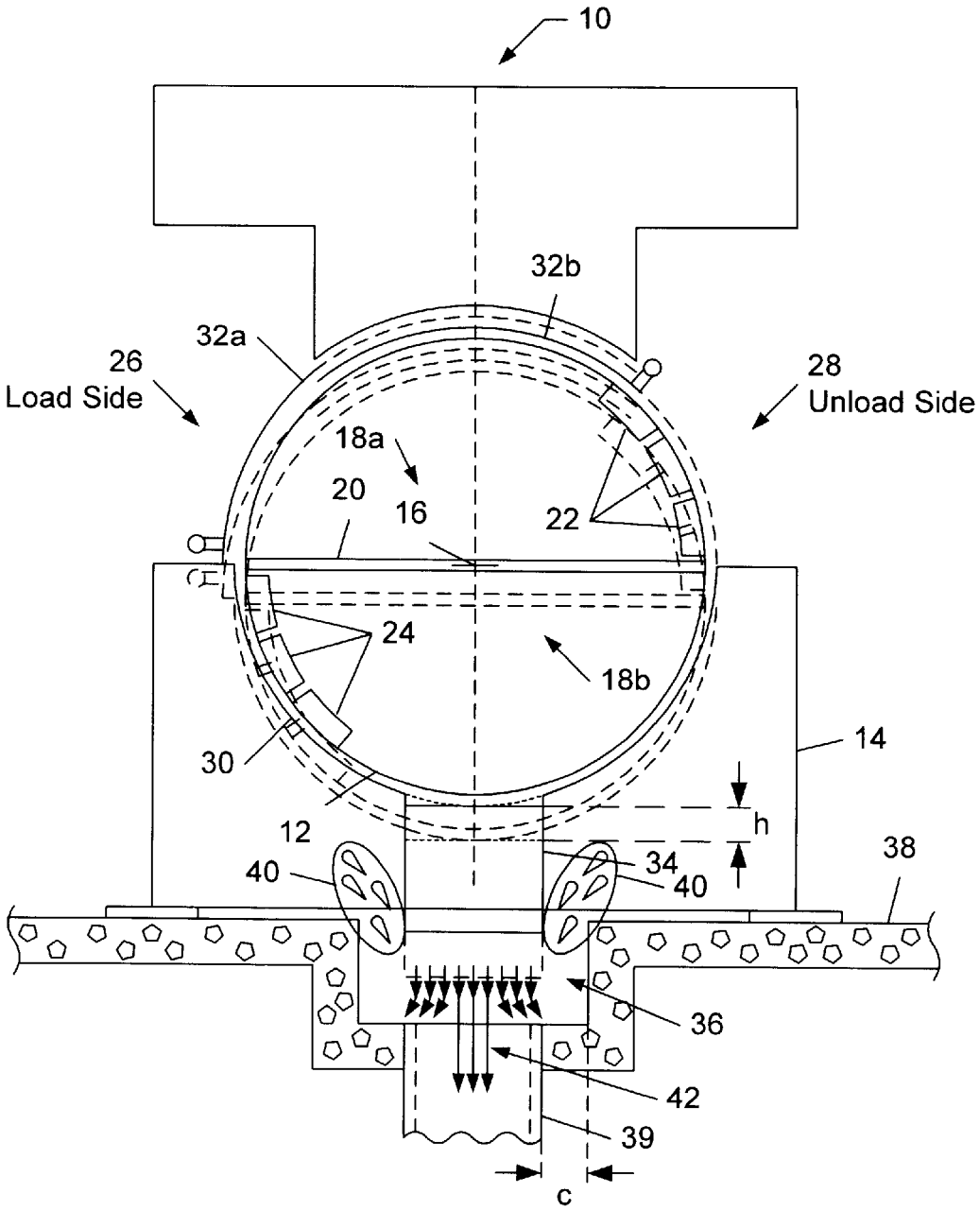
Fig. 3 (Prior Art)
FIG. 3 is a side cross-sectional view of the washer/extractor of FIGS. 1 and 2 wherein a drum and a surrounding outer shell of the washer/extractor are raised a height h above a normal position and held there during an extraction operation, and wherein a portion of water entering the trench from the drain line may splash out of an upper opening of the trench and onto a floor surrounding the trench.

The maximum allowable amount of movement between drain line 34 and conduit 52 perpendicular to aligned axes 56 and 58 is a distance "$d_1$" between an outer dimension of drain line 34 and an inner dimension of opening 60 of conduit 52. Distance $d_1$ may be equal to clearance c shown in FIG. 3 (e.g., 3.5 inches±0.5 inch). In order for splash plate 54 to accommodate the maximum allowable amount of movement between drain line 34 and conduit 52, an outer edge of splash plate 54 must extend beyond an outer edge of lip 62 a distance "$d_2$" where distance $d_2$ is greater than or equal to distance $d_1$.

Drain line 34 and conduit 52 may have substantially circular cross sections, and lip 62 surrounding opening 60 in the end of conduit 52 may be substantially circular. Splash plate 54 may be a substantially circular disk having a substantially planar top surface opposed to bottom surface 64. Hole 66 may be substantially circular, extending between the opposed top and bottom surfaces. Conduit 52 may an inner diameter greater than an outer diameter of drain line 34, or the end of conduit 52 may be flared as shown in FIGS. 4 and 5 such that opening 60 forms a mouth having a diameter greater than an outer diameter of drain line 34. Conduit 52 may be a single piece or an assemblage of separate pieces connected together. For example, the flared end of conduit 52 may be created by fixing a collar about an end of a section of pipe.

During the extraction operation, the drain valve between drum 12 and drain line 34 is typically open as described above, allowing water to flow from drum 12 into drain line 34. Water 68 exiting drain line 34 enters opening 60 of conduit 52. Any portion of water 68 splashing up between drain line 34 and the inner dimension of the end of conduit 52 impacts splash plate 54 and is contained within drain system 50. Thus drain system 50 prevents a portion of water 68, possibly containing dissolved chemicals (e.g., detergent) and/or particulate matter flushed from the textiles within drum 12, from splashing out of drain system 50 and becoming a source of particulate contamination within the clean room. Although not airtight, drain system 50 may also help isolate the area within conduit 52 from the area surrounding drain system 50.

In a clean room application, conduit 52 and splash plate 54 are preferably fabricated from stainless steel. In other applications, conduit 52 and splash plate 54 may be made from a non-corrosive metal (e.g., aluminum), made from a metal and subsequently coated with a non-corrosive coating (e.g., chromium, zinc, plastic, enamel, etc.), or from a plastic (e.g., polyvinyl chloride).

It is noted that drain system 50 may be used to form a substantially splash proof drain assembly in any application where mechanical isolation is desired between a drain line subject to movement and a fixed conduit.

It will be appreciated by those skilled in the art having the benefit of this disclosure that this invention is believed a splash proof drain system providing mechanical isolation between a drain line subject to movement and a fixed conduit, wherein the drain system is suitable for use in a semiconductor fabrication clean room. It is intended that the following claims be interpreted to embrace all such modifications and changes and, accordingly, the specification and drawings are to be regarded in an illustrative rather than a restrictive sense.

What is claimed is:

1. A drain system for conveying a liquid exiting a drain line, the drain system comprising:

a conduit having an axis substantially aligned with an elongated axis of the drain line, wherein a lip surrounding an end of the conduit is larger in diameter than an outer surface of the drain line;

a splash plate having a substantially planar surface and a hole extending through the splash plate is dimensioned to receive the outer surface of the drain line; and wherein the end of the drain line extends through the hole of the splash plate and into the conduit opening, and wherein the substantially planar surface of the splash plate is in moveable and continuous contact with the conduit lip.

2. The drain system as recited in claim 1, wherein the splash plate allows limited relative movement between the drain line and the conduit while providing a substantially splash proof connection between the drain line and the conduit.

3. The drain system as recited in claim 2, wherein the hole in the splash plate forms an inner dimension of the splash plate, and wherein a space is formed between the outer dimension of the drain line and the inner dimension of the splash plate, and wherein the space is dimensioned to allow limited relative movement between the drain line and the conduit along the axes of the drain line and the conduit while providing a substantially splash proof joint between the drain line and the splash plate.

4. The drain system as recited in claim 2, wherein the continuous contact between the substantially planar surface of the splash plate and the conduit lip allows limited relative movement between the drain line and the conduit in a direction perpendicular to the axes of the drain line and the conduit while providing a substantially splash proof joint between the splash plate and the conduit.

5. The drain system as recited in claim 1, wherein the axes of the drain line and the conduit are substantially vertical, and wherein the substantially planar surface of the splash plate forms a substantially horizontal plane, and wherein the weight of the splash plate urges the splash plate toward the lip of the conduit such that the substantially planar surface of the splash plate makes continuous contact with the conduit lip despite any relative movement between the drain line and the conduit.

6. The drain system as recited in claim 1, wherein the end of the conduit is flared such that the opening forms a mouth having a dimension larger than the outer dimension of the drain line.

7. The drain system as recited in claim 1, wherein the splash plate has opposed and substantially planar major surfaces, and wherein the hole extends between the opposed surfaces, and wherein one of the substantially planar surfaces makes continuous contact with the conduit lip.

8. The drain system as recited in claim 1, wherein the drain line and the conduit have substantially circular cross sections, and wherein the lip surrounding the opening in the end of the conduit is substantially circular, and wherein the splash plate is a substantially circular disk, and wherein the hole in the disk is substantially circular.

9. The drain system as recited in claim 8, wherein an outer edge of the splash plate extends beyond an outer edge of the conduit lip a first distance, wherein the first distance is greater than or equal to a second distance between an outer diameter of the drain line and an inner diameter of the conduit opening.

10. The drain system as recited in claim 1, wherein the conduit and splash plate comprise a non-corrosive metal.

11. The drain system as recited in claim 1, wherein the conduit and splash plate comprise stainless steel.

12. A washing apparatus, comprising:

a washer having a drum adapted to receive garments placed into the drum from a semiconductor fabrication clean room;

a drain line extending from the drum to a terminating end of the drain line for conveying wash byproducts from the drum;

a conduit having opposed ends, one of which has a lip that is aligned a spaced, circumferential distance about the terminating end of the drain line; and a splash plate extending about the terminating end of the drain line and gravitationally forced against the lip to maintain the conveyed wash byproducts within the conduit whenever the drain line moves relative to the conduit.

13. The washing apparatus as recited in claim 12, wherein said splash plate comprises a weight which produces the gravitational force.

14. The washing apparatus as recited in claim 12, further comprising another end of the conduit is coupled to a sewage pipe.

15. The washing apparatus as recited in claim 12, wherein the splash plate comprises an outer perimeter that extends beyond said lip by a distance greater than the spaced, circumferential distance separating the lip and the terminating end of the drain line.

16. The washing apparatus as recited in claim 12, wherein the drain line is fixed to the washer and the drum.

17. The washing apparatus as recited in claim 12, wherein the drain line and the splash plate are moveable along an axis shared by drain line and conduit and along a plane perpendicular to the axis shared by the drain line and conduit.

* * * * *